US006035962A

United States Patent [19]

Lin

[11] Patent Number: 6,035,962

[45] Date of Patent: Mar. 14, 2000

[54] EASILY-COMBINABLE AND MOVABLE SPEAKER CASE

[76] Inventor: Chih-Hsiung Lin, P.O. Box 90, Tainan City, Taiwan

[21] Appl. No.: 09/256,767

[22] Filed: Feb. 24, 1999

[51] Int. Cl.[7] ..... A47B 81/06

[52] U.S. Cl. ..... 181/199; 181/198; 181/175; 181/189; 181/190; 181/148; 381/87; 381/332; 381/333; 381/334; 381/386; 381/387; 312/7.1; 312/7.2; 312/8.16; 312/183; 312/185; 312/188

[58] Field of Search ..... 181/199, 198, 181/175, 148, 150, 177, 179, 189, 190, 156; 381/87, 332, 333, 334, 386, 387, 388; 312/7.1, 7.2, 8.16, 183, 185, 188

[56] References Cited

U.S. PATENT DOCUMENTS 4,452,333 6/1984 Peavey et al. ..... 181/144

5,519,572 5/1996 Luo ..... 361/685

5,781,853 7/1998 Johnson ..... 455/351

*Primary Examiner*—Brian Sircus

*Assistant Examiner*—Edgardo San Martin

[57] ABSTRACT

An easily-combinable and movable speaker case includes two side boards, a front holed board, a speaker support board, an electric circuit board, a rear control board, a cap board, a bottom board, and a pull member. The two side boards are spaced apart parallel and respectively has a plurality of vertical position grooves and posts spaced apart on an inner surface for inserting the front holes board, the speaker support board, the electric circuit board and the control board in the position grooves of the two side board. Then the cap board and the bottom board are respectively fixed on and under the two side boards with screws. Further two rollers are fixed under the bottom board to permit the speaker case inclinedly move on the ground by pulling the pull member.

3 Claims, 6 Drawing Sheets

EASILY-COMBINABLE AND MOVABLE SPEAKER CASE

BACKGROUND OF THE INVENTION

This invention relates to an easily-combinable and movable speaker case, Particularly to one having two side boards respectively provided with a plurality of vertical position grooves in an inner surface for various component boards to be inserted vertically between the two side boards to facilitate assemblage of the speaker case. In addition, two roller are fixed under a bottom board, enabling the speaker case move around on the ground by an extensible pulling member.

Conventional speaker cases generally include speakers, electric circuit boards, etc. fixed in the case with screws. And the case has side boards, a cap board and a bottom board assembled together with screws. Thus, conventional speaker cases depend on many screws in assemblage, taking much work and time. Besides, if any components will be replaced, the screws have to be loosened, which is very inconvenient. Moreover, screws are liable to be lost, causing more trouble. Furthermore, moving conventional speaker cases may need more than one person, if they should be large. Then a light duty low bed truck may be needed to transport them, which is very inconvenient.

SUMMARY OF THE INVENTION

This invention has been devised to offer an easily-combinable and movable speaker case for easy assemblage and moving around readily.

The main feature of the invention is two side boards respectively Provided with a plurality of vertical position grooves and posts on an inner surface so that a front holes boards, a speaker support board, an electric circuit board and a rear control board may be positioned between the two side boards by inserting two sides of each board in the vertical position grooves of the two side boards. Then this speaker case is easily combined together. Further, two rollers are fixed under a bottom board for permit the speaker case move around on the ground by inclining it and pulled by a pull member extensibly provided with the rear control board.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
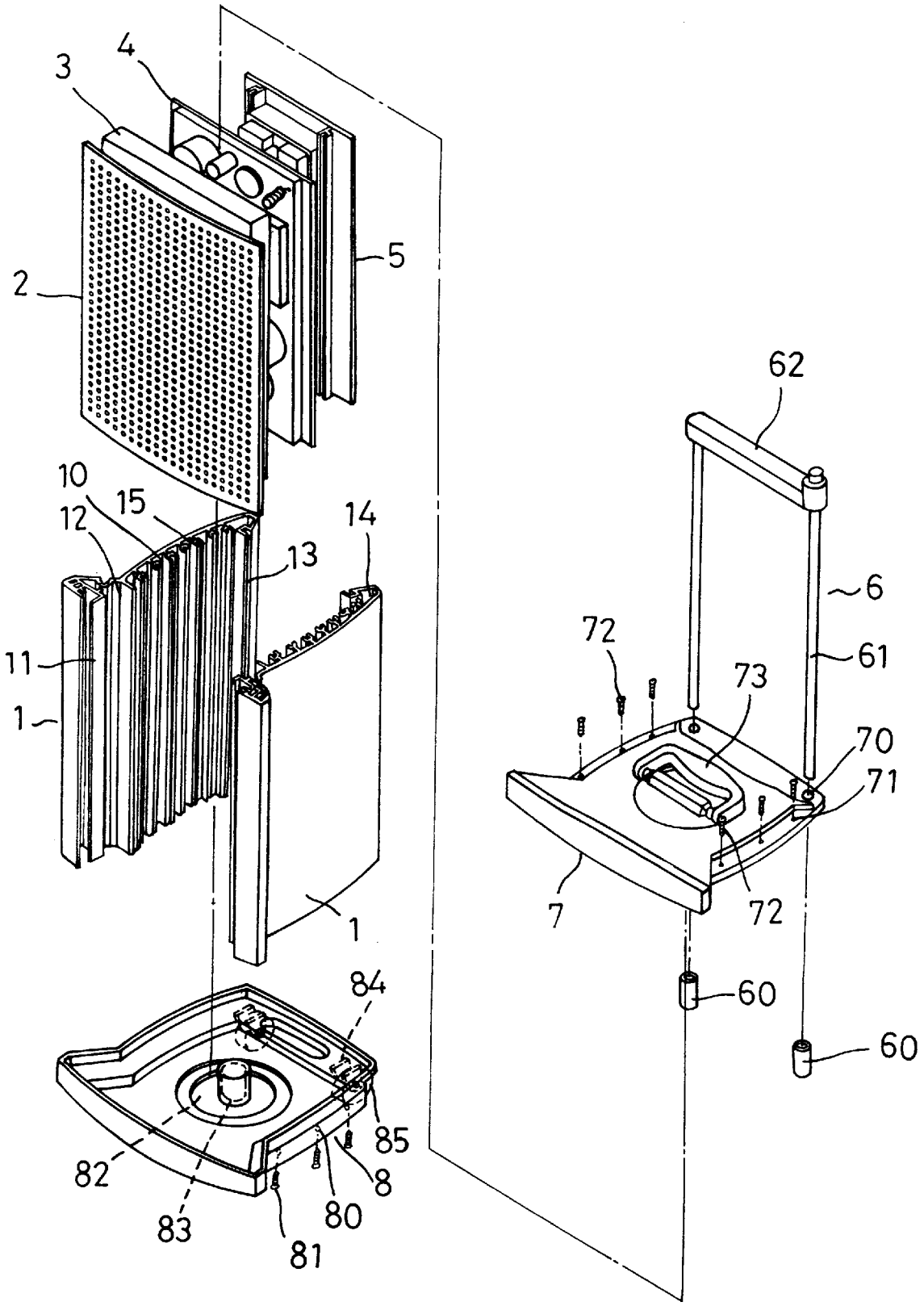
FIG. 1 is an exploded perspective view of an easily-combinable and movable speaker case in the present invention.
Figure 3:
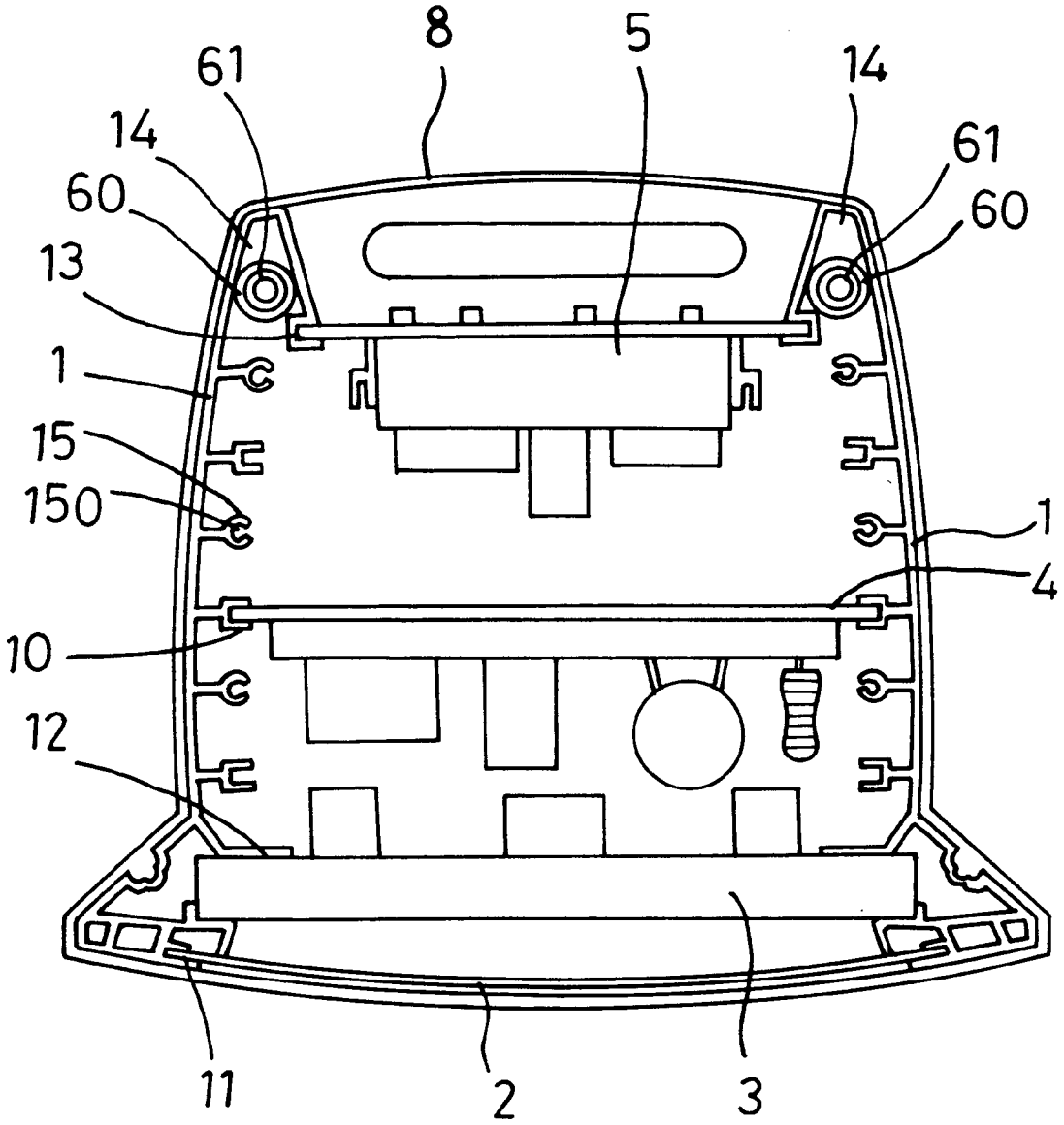
FIG. 3 is an upper view of inner components of the easily-combinable and movable speaker case in the present invention.

A preferred embodiment of an easily-combinable and movable speaker case in the present invention, as shown in FIGS. 1 and 3, includes two side boards 1, a front holed board 2, a speaker support board 3, an electric circuit board 4, a rear control board 5, a pull member 6, a cap board 7, and a bottom board 8 as main components combined together.

The two side boards 1 are spaced apart properly and in parallel to each other, respectively having a plurality of vertical Position grooves 10, 11, 12, 13, 14 and a plurality of vertical posts 15 formed on an inner surface spaced apart between the position grooves 10, 11, 12, 13 and 14. Further, a hole 150 is bored between every two posts 15.

The front holed board 2 is located between the two side boards 1, with its two sides fitting in the position grooves 11 in the front end of the two side boards 1.

The speaker support board 3 is located just behind the front holed board 2 and between the two side boards 1, with its two sides fitting in the position grooves 12 of the two side boards 1.

The electric circuit board 4 is located between the two side boards 1. with its two sides fitting in the position grooves 10 of the two side boards 1.

The rear control plate 5 is located between the rear end of the two side boards 1, with its two sides fitting in the position grooves 13 of the two side boards 1.

A pull member 6 is combined with the rear ends of the two side boards 1, having two sleeves 60 fitting in the position grooves 14 at the rear ends of the two side boards 1, and two extensible rods 61 fitting in the sleeves 60 and extensible upward and collapsible downward, and a lateral grip 62 connected firmly between the two extensible rods 61.

An cap board 7 is located to close on the space between on the two side boards 1. having a hole 70 respectively in two sides of the rear end for the extensible rods 61 to pass through, several holes 71 respectively in two sides at corresponding locations of the posts 15 of the two side boards 1 for screws 72 to pass through to screw with the posts 15 so as to assemble the cap board 7 with the two side boards 1. Further, a carry handle 73 is provided on an outer surface of the cap board 7 for carrying the speaker case manually.

The bottom board 8 is located under the two side boards 1, having holes 80 in two sides at corresponding locations of the posts 15 for screws to pass through to screw with the posts 15 so as to assemble the bottom board 8 with the two side boards 1. Further, a fix means 82 is fixed under the center portion of the bottom board 8, having a recess 83 for a tripod A. The bottom board 8 further has two roller supporters 85 for supporting two rollers 85.

Figure 2:
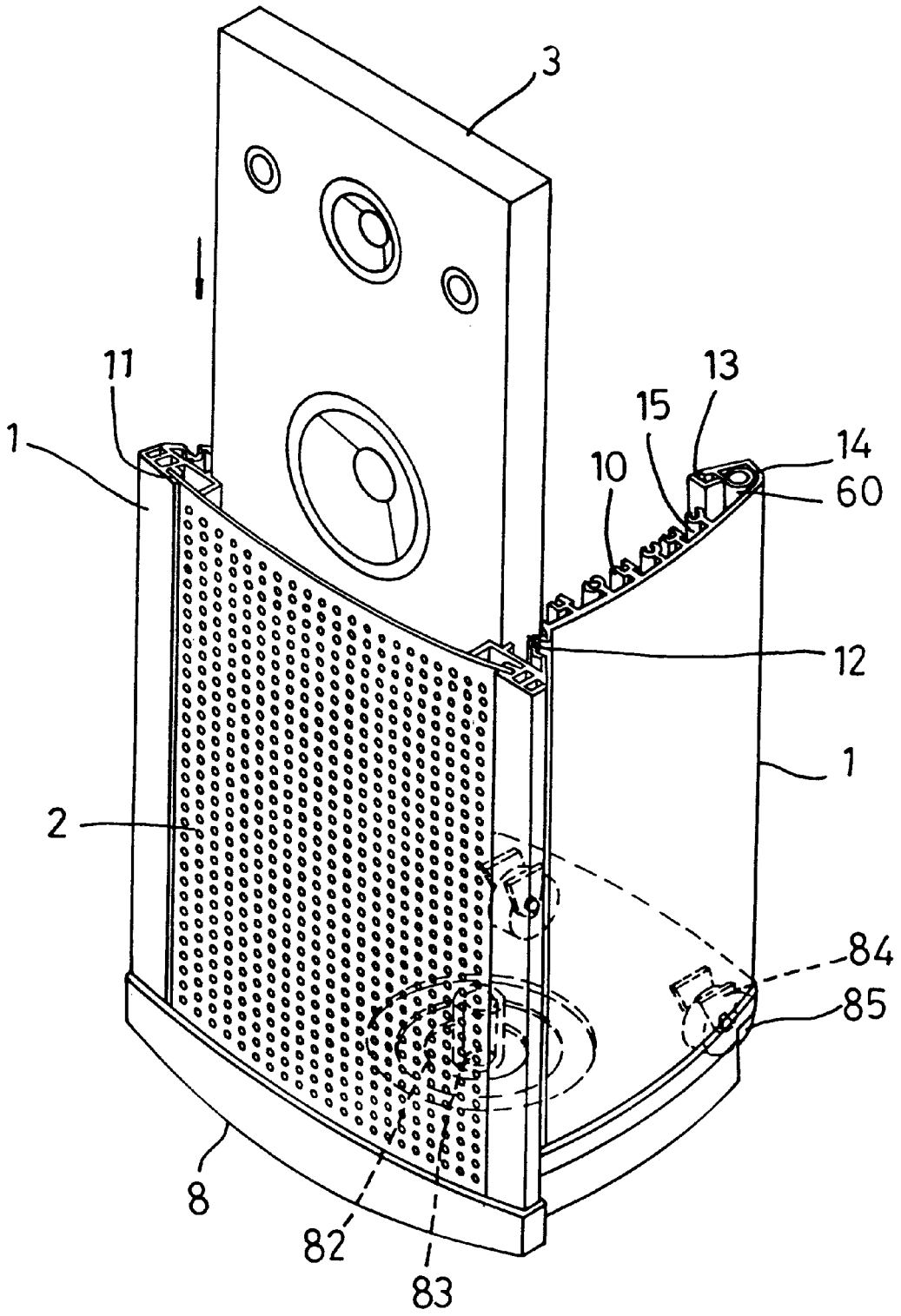
FIG. 2 is a perspective view of some components of the easily-combinable and movable speaker case being assembled in the present invention.
Figure 4:
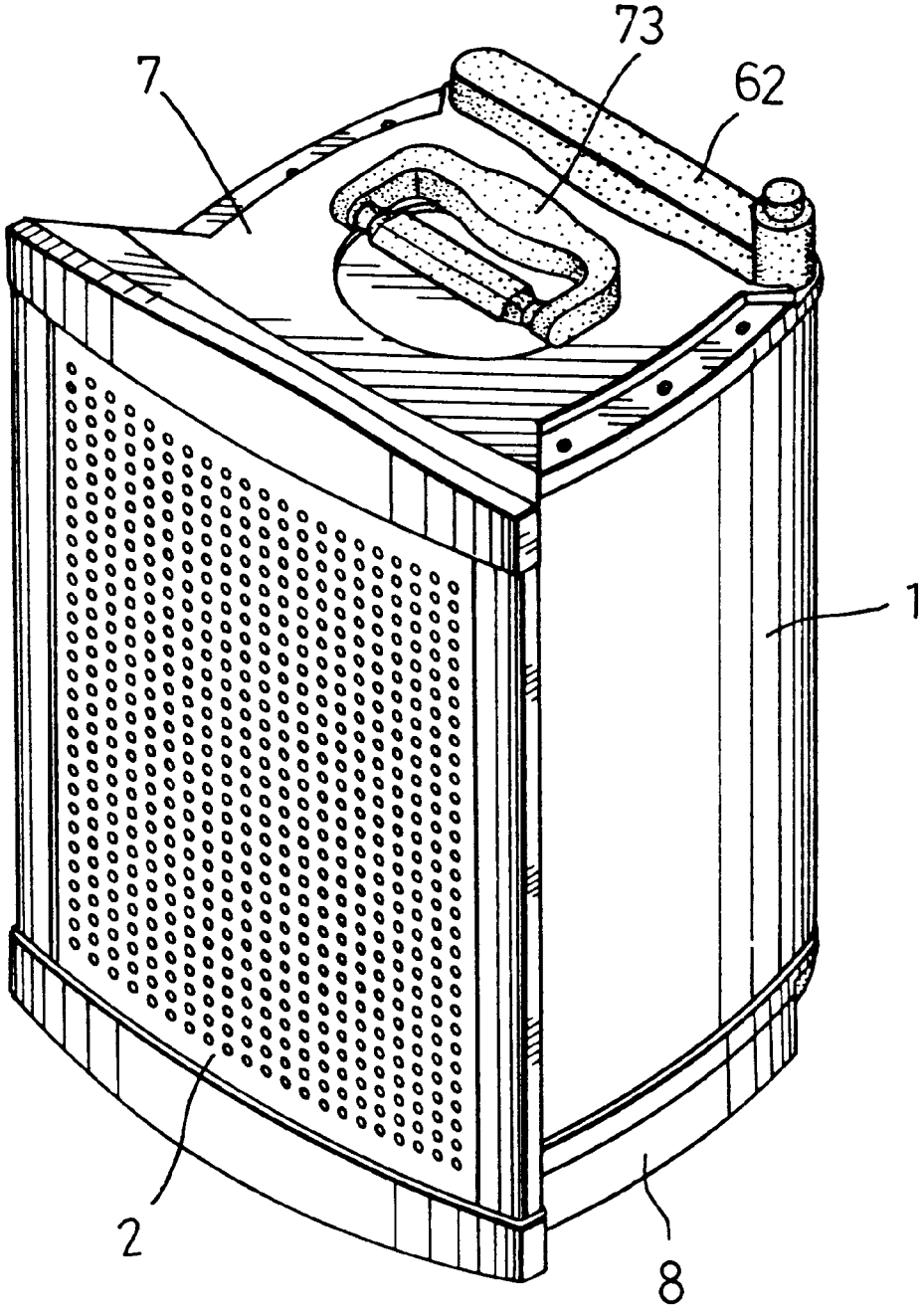
FIG. 4 is a perspective view of the easily-combinable and movable speaker case in the present invention.

In assembling, referring to FIGS. 1, 2 and 3, firstly, the two side boards 1 are combined firmly with the two sides of the bottom base 8, with screws passing through the holes 80 and screwing with the bottoms of the posts 15. Then the speaker support board 3 is inserted from upside in the position grooves 12 of the two side boards 1 and stabilized between them. Next, the electric circuit board 4 is also inserted in the position grooves 10 of the two side boards 1. After that the front holes board 2 and the control board 5 are respectively inserted in the position grooves 11 and 13, forming a speaker case as shown in FIG. 3. Then the sleeves 60 of the pull member 6 are fitted in the position grooves 14 of the two sides boards 1, with the extensible rods 61 inserted through the holes 70 of the cap board 7 and in the sleeves 60. Then the cap board 7 is put on the two side boards 1, with the screws passing through the holes 71 of the cap board 7 and screwing with the upper ends of the posts 15 to fix the cap board 7 with the two side boards 1, protecting the various components positioned in the the two side boards 1, the front holed board 2 and the rear control board 5. Finally, the two rollers 85 are combined with the roller supporters 84 to finish assemblage of the speaker case in the present invention, as shown in FIG. 4.

Figure 5:
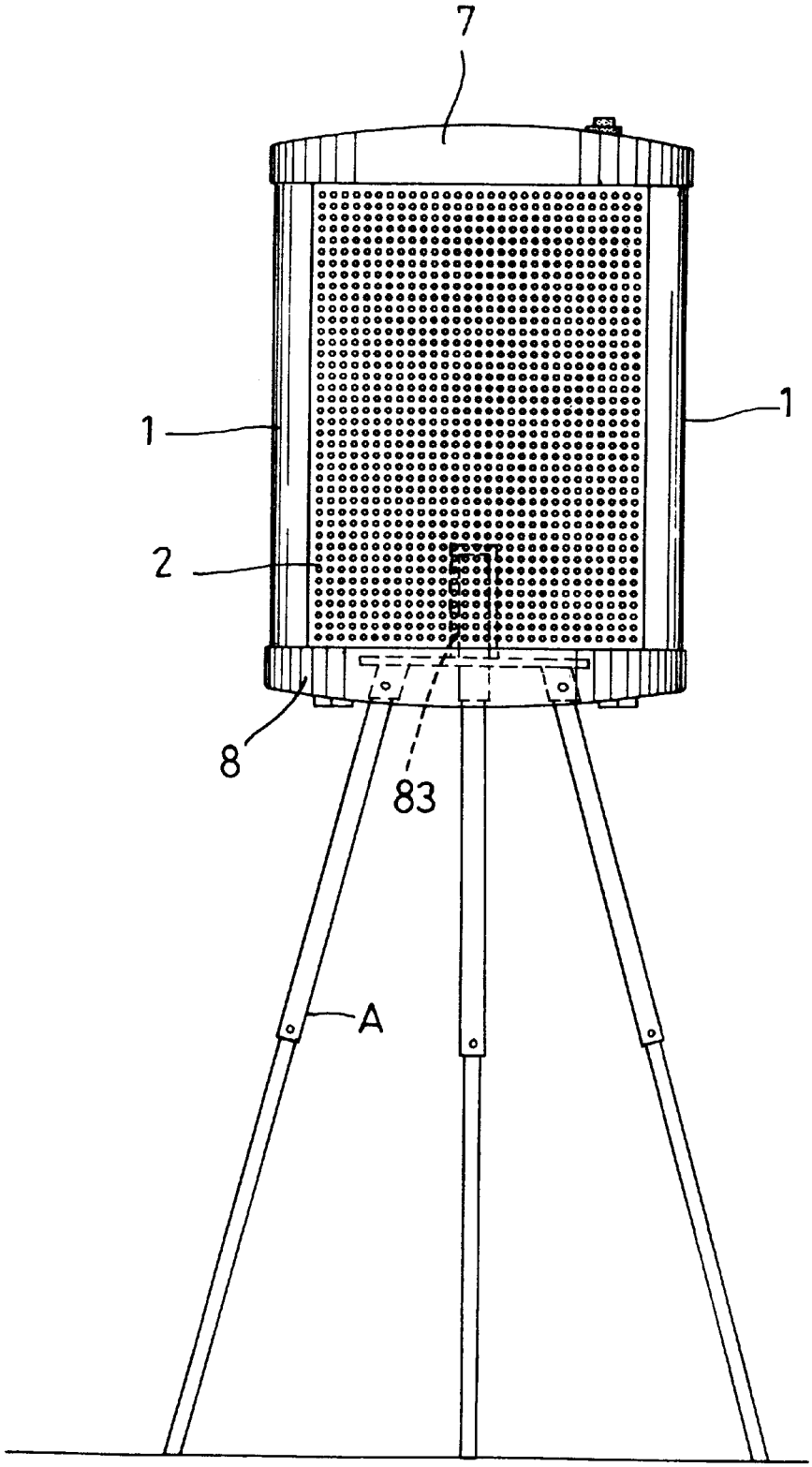
FIG. 5 is a front view of the easily-combinable and movable speaker case supported on a tripod in the present invention; and, FIG. 6 is a perspective view of the easily-combinable and movable speaker case being moved by a person.
Figure 6:
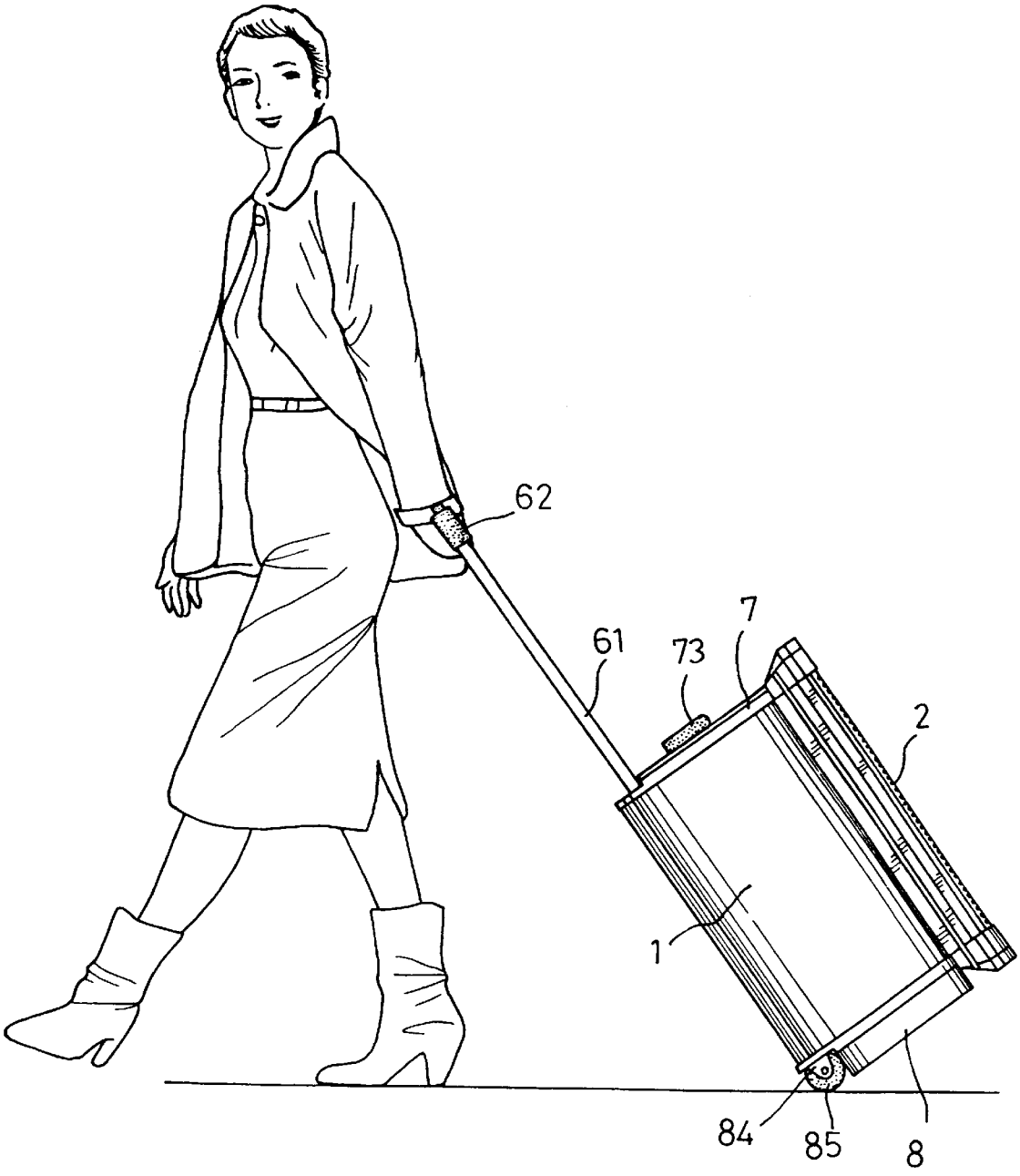

As just described above, the speaker case can be quickly combined together, saving time and work. In addition, the fix member 82 is fixed under the bottom board 8 so as to be temporarily positioned on a tripod A to raise up the speaker case if needed, as shown in FIG. 5. The carry handle 73 can serve carrying manually the speaker case, and the rollers 85 can be used to pull to move the speaker case on the ground by pulling up the pull rod 6 and inclining the speaker case for a certain angle, as shown in FIG. 6. Besides, in case any components gets out of order, the screws 72 of the cap board 72 are only needed to be loosened to permit the cap board 7 removed for pulling out any of the damaged board for repair. Thus, the speaker case is easy to assemble, maintain, repair and move, saving cost largely in manufacturing.

While the preferred embodiment of the invention has been described above, it will be recognized and understood that various modifications may be made therein and the appended claims are intended to cover all such modifications which may fall within the spirit and scope of the invention.

What is claimed is:

1. An easily-combinable and movable speaker case comprising two side boards, a front holed board, an electric circuit board, a speaker support board, a rear control board, a cap board and a bottom board; and characterized by said two side boards properly spaced apart and in parallel and respectively having a plurality of vertical position grooves and posts in an inner surface, said front holed board, said electric circuit board, said speaker support board and said control board respectively positioned between said two side boards with two sides of each board inserted in each pair of said position grooves of said two side boards, said cap board and said bottom board respectively fixed on and under said two side boards with screws, two rollers fixed on a lower surface of said bottom board, thus said boards described above being assembled between said two side boards by means of inserting process so as to permit assemblage of said speaker case or replacement of components quickly performed, said speaker case being easily moved on the ground by means of said two rollers.

2. The easily-combinable and movable speaker case as claimed in claim 1, wherein a carry handle is provided on an upper surface of said cap board, and said cap board has a hole respectively at two sides for two extensible rods of a pull member to fit through and fitted in a sleeve at a lower end, and said sleeves are inserted in one of said position grooves of each said side board so that said pull member may be pulled up and pushed down in said position grooves of said two side boards for pulling to move said speaker case on the ground.

3. The easily-combinable and movable speaker case as claimed in claim 1, wherein a fix means is further fixed under said bottom board, having a recess for combining a tripod under said speaker case to adjust the height of said speaker case.

* * * * *